US006397806B2

(12) United States Patent
Imai et al.

(10) Patent No.: US 6,397,806 B2
(45) Date of Patent: Jun. 4, 2002

(54) ENGINE VALVE ASSEMBLY FOR INTERNAL COMBUSTION ENGINE

(75) Inventors: Hiroaki Imai, Saitama; Hirokazau Uehara; Seiji Tsuruta, both of Kanagawa, all of (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/864,303

(22) Filed: May 25, 2001

(30) Foreign Application Priority Data

May 30, 2000 (JP) ..... 2000-159487

(51) Int. Cl.[7] ..... F01L 1/24

(52) U.S. Cl. ..... 123/90.48; 184/6.9; 123/90.33; 123/90.49; 123/196 M

(58) Field of Search ..... 123/90.27, 90.33, 123/90.35, 90.48, 90.52, 196 M; 184/6.9

(56) References Cited

U.S. PATENT DOCUMENTS

| | | | | | |
|---|---|---|---|---|---|
| 3,704,696 | A | * | 12/1972 | Abell | 123/90.33 |
| 4,745,888 | A | * | 5/1988 | Kapp | 123/90.33 |
| 5,154,143 | A | * | 10/1992 | Stutzenberger | 123/90.12 |
| 5,365,897 | A | * | 11/1994 | Speil et al. | 123/90.52 |
| 5,596,959 | A | * | 1/1997 | Kenmoku et al. | 123/90.33 |
| 5,615,651 | A | * | 4/1997 | Miyachi | 123/198 F |
| 5,749,341 | A | | 5/1998 | Hosaka et al. | 123/90.35 |
| 5,870,985 | A | * | 2/1999 | Bretting | 123/90.55 |
| 5,934,236 | A | * | 8/1999 | Rao et al. | 123/90.51 |
| 5,954,020 | A | * | 9/1999 | Schmidt et al. | 123/90.48 |
| 6,032,643 | A | * | 3/2000 | Hosaka et al. | 123/321 |
| 6,293,239 | B1 | * | 9/2001 | Herbst | 123/90.16 |

FOREIGN PATENT DOCUMENTS

| | | | | |
|---|---|---|---|---|
| DE | 4332110 A1 | * | 3/1995 | |
| JP | 60147520 | * | 8/1985 | 184/6.9 |

OTHER PUBLICATIONS

Japanese Industrial Standards JIS G 4052, (1979), Japanese Industrial Standard Committee, "Structural Steels with Specified Hardenability Bonds", 1 page.

* cited by examiner

*Primary Examiner*—Thomas Denion
*Assistant Examiner*—Ching Chang
(74) *Attorney, Agent, or Firm*—Foley & Lardner

(57) ABSTRACT

In an engine valve assembly, a valve lifter comprises a cylindrical main body portion and a head wall portion by which an opening of the cylindrical main body portion is enclosed and with which a cam is brought in contact, a valve stem is contacted on an axial center of the valve lifter and is disposed obliquely with respect to a direction of gravity, an exit of a lubricating oil supply bore is opened to an inner space of the head wall portion and is revolved due to a revolution of the valve lifter caused by a friction developed on the basis of a revolution of the cam, and a spring retainer supports an end of a valve spring, the spring retainer being attached onto the valve stem.

16 Claims, 5 Drawing Sheets

ENGINE VALVE ASSEMBLY FOR INTERNAL COMBUSTION ENGINE

BACKGROUND OF THE INVENTION a) Field of the Invention

The present invention relates generally to an engine valve assembly having a valve lifter interposed between an engine valve body such as an intake or exhaust valve and a cam pressing the engine valve body under a given pressure.

b) Description of the Related Art

A U.S. Pat. No. 5,749,341 issued on May 12, 1998 exemplifies a previously proposed valve lifter for an internal combustion engine.

The valve lifter disclosed in the above-described United States Patent includes a recess portion formed on an upper surface of a summit wall of a bell-shaped cylindrical main body; and a shim for adjusting a valve clearance housed in the recess portion. A circular groove which communicates each through hole at the recess portion with the shim is formed on an upper surface of a bottom wall of the recess portion. A lubricating oil dropped on an upper surface of the shim is dropped on a spring retainer via the shim and through hole of the recess portion. The lubricating oil jumped from the spring retainer due to an operation of a valve spring is supplied to a contact portion between a valve stem and the valve lifter.

SUMMARY OF THE INVENTION

However, in the engine valve assembly disclosed in the above-identified United States patent, the shim for adjusting valve clearance is attached onto the valve lifter separately from the main body of the valve lifter. Hence, due to a friction (frictional force) developed on a slide portion between the cam and adjusting shim along with revolution of the cam, this adjusting shim only is revolved and the valve lifter main body itself is not revolved.

That is to say, the friction between the adjusting shim and valve lifter when the adjusting shim is revolved causes a torque to be transmitted to the main body of the valve lifter itself. However, since the frictional force between an outer periphery of valve lifter and a guide hole of a cylinder head to guide a slid motion of valve lifter main body is larger than the frictional force between the shim and valve lifter main body, the valve lifter main body is rarely revolved but the lubricating oil is dropped onto a portion at which a quantity of lubricating oil becomes substantially constant.

In a case where the valve lifter is inclined with respect to the cylinder head and the valve lifter is not revolved with the outlet of the through hole placed at a lowest end portion, almost all of lubricating oil from the outlet of the through hole is transmitted onto the inner surface of the valve lifter. Even if the lubricating oil is dropped onto the spring retainer. A very small quantity of lubricating oil is dropped onto the spring retainer. Consequently, a sufficient lubrication cannot be carried out in a contacting portion between the valve stem and valve lifter and spring retainer.

It is, therefore, an object of the present invention to provide an engine valve assembly for an internal combustion engine in which a sufficient lubrication can be carried out for a contact portion between the valve stem and valve lifter and the spring retainer even if the valve lifter is disposed on the cylinder head obliquely with respect to a direction of gravity.

The above-described object can be achieved by providing an engine valve for an internal combustion engine, comprising: a valve lifter comprising a cylindrical main body portion and a head wall portion by which an opening of the cylindrical main body portion is enclosed and with which a cam is brought in contact; a valve stem contacted on an axial center of the valve lifter and disposed obliquely with respect to a direction of gravity; a lubricating oil supply bore whose exit is opened to an inner space of the head wall portion and is revolved due to a revolution of the valve lifter caused by a friction developed on the basis of a revolution of the cam; and a spring retainer to support an end of a valve spring, the spring retainer being attached onto the valve stem.

The above-described object can also be achieved by providing an engine valve for an internal combustion engine, comprising: a valve lifter comprising a cylindrical main body portion and a head wall portion by which an opening of the cylindrical main body portion is enclosed and with which a cam is brought in contact; a valve stem contacted on an axial center of the valve lifter and disposed obliquely with respect to a direction of gravity; a lubricating oil supply bore whose exit is opened to an inner space of the head wall portion and is formed in plural for each predetermined interval of distance in a circumferential direction of the head wall portion; and a spring retainer to support an end of a valve spring, the spring retainer being attached onto the valve stem.

The above-described object can also be achieved by providing an engine valve for an internal combustion engine, comprising: a valve lifter comprising a cylindrical main body portion and a head wall portion integrally formed with the cylindrical main body and by which an opening of the cylindrical main body portion is enclosed and with which a cam is brought in contact; a valve stem contacted on an axial center of the valve lifter and disposed obliquely with respect to a direction of gravity; a lubricating oil supply bore formed to penetrate through the head wall portion and whose exit is opened to an inner space of the head wall portion and is revolved due to a revolution of the valve lifter caused by a friction developed on the basis of a revolution of the cam; and a spring retainer to support an end of a valve spring, the spring retainer being attached onto the valve stem.

The above-described object can also be achieved by Providing an engine valve for an internal combustion engine, comprising: a valve lifter comprising a cylindrical main body portion and a head wall portion by which an opening of the cylindrical main body portion is enclosed and with which a cam is brought in contact; a valve stem contacted on an axial center of the valve lifter and disposed obliquely with respect to a direction of gravity; a lubricating oil supply bore whose exit is opened to an inner space of the head wall portion and is revolved due to a revolution of the valve lifter caused by a friction developed on the basis of a revolution of the cam and whose inlet is formed on an upper surface of the head wall portion on which the can is contacted, an opening edge of the inlet of which is formed in an arc shape; and a spring retainer to support an end of a valve spring, the spring retainer being attached onto the valve stem.

The other objects and features of this invention will become understood from the following description with reference to the accompanying drawings.

DETAILED DESCRIPTION OF THE PREFERRED EMBODIMENT

Reference will hereinafter be made to the drawings in order to facilitate a better understanding of the present invention.

(First Embodiment)

Figure 1:
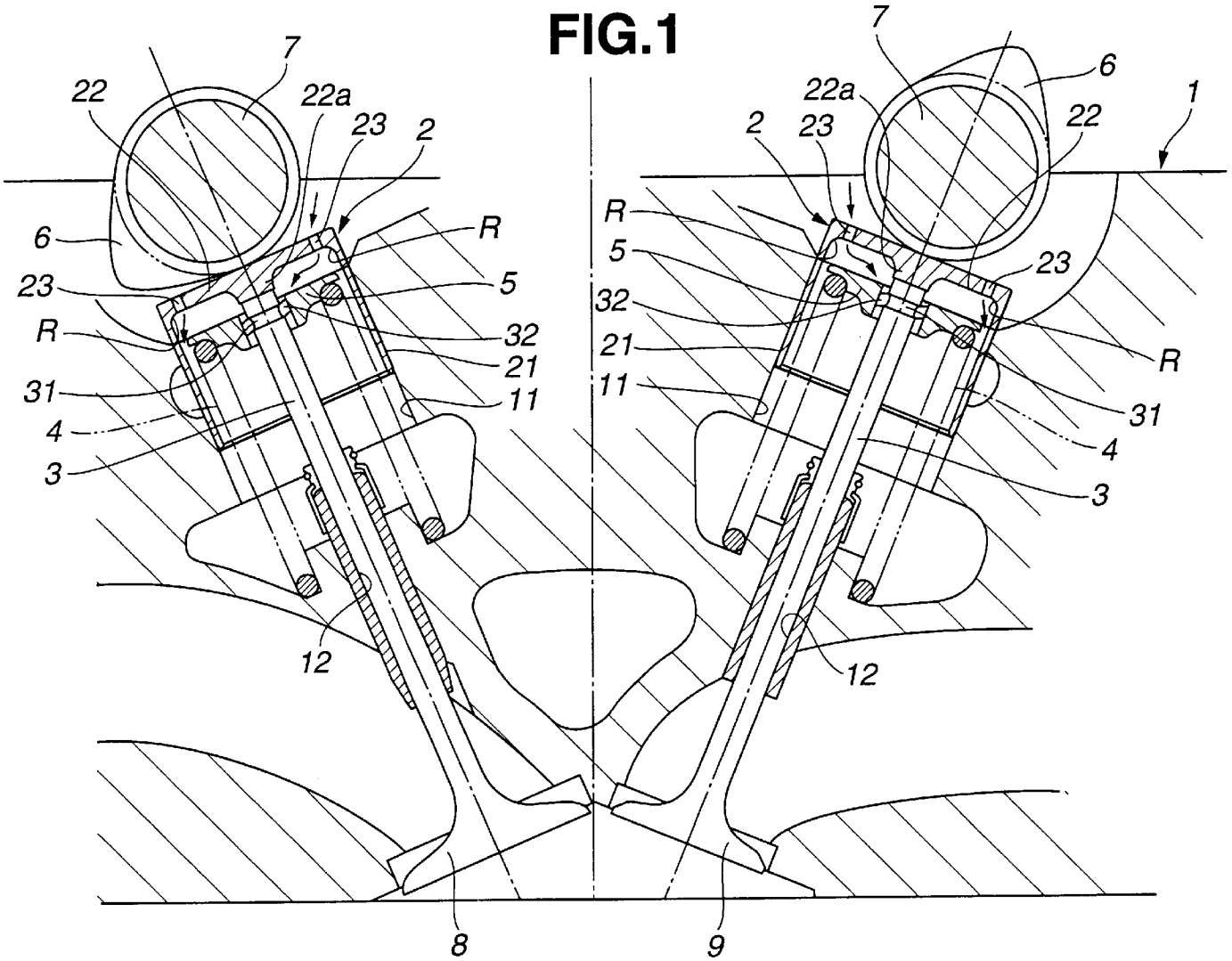
FIG. 1 is a longitudinal cross sectional view representing an engine valve assembly (such as an intake valve assembly and exhaust valve assembly) including a valve lifter in a first preferred embodiment according to the present invention.

FIG. 1 shows a longitudinally cross sectional view of an engine valve for an internal combustion engine in a first preferred embodiment according to the present invention.

Figure 2:
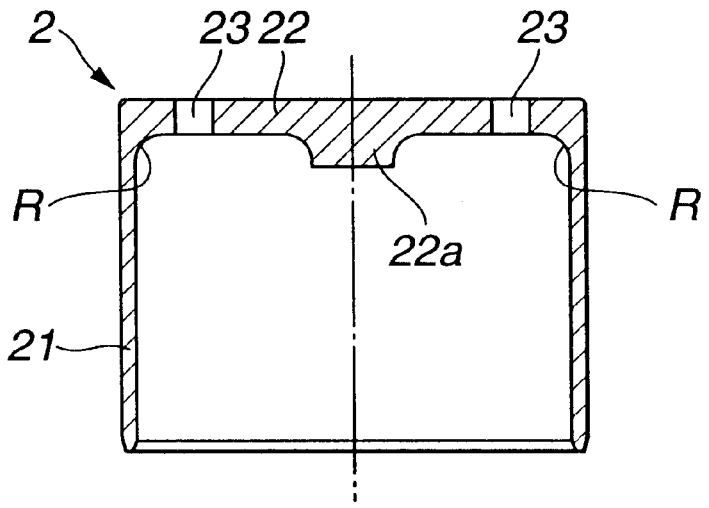
FIG. 2 is a longitudinal cross sectional view of the valve lifter shown in FIG. 1.

FIG. 2 shows a longitudinally cross sectional view of a valve lifter shown in FIG. 1.

Figure 3:
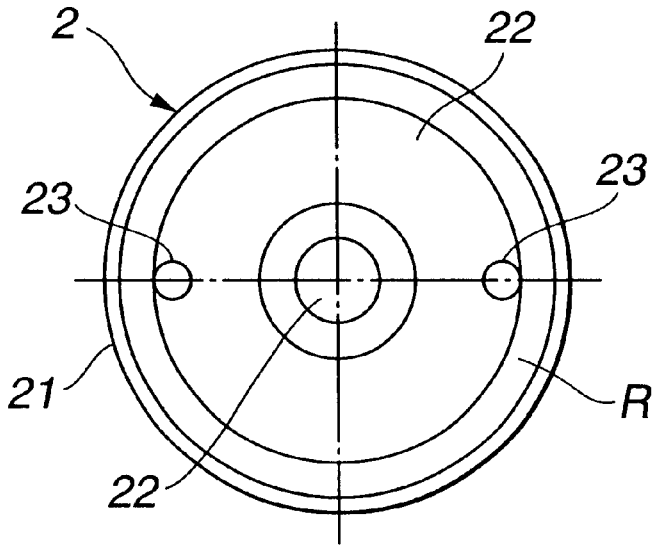
FIG. 3 is a bottom view of the valve lifter shown in FIG. 1.

FIG. 3 shows a bottom view of the valve lifter shown in FIGS. 1 and 2.

In FIGS. 1, 2, and 3, a cylinder head 1 is provided with valve lifter 2, a valve stem 3, a valve spring 4 such as a coil spring, a valve operating cam 6, a camshaft 7, and an intake valve 8 or exhaust valve 9.

In details, the valve lifter 2 is interposed between the valve stem 3 and cam 6. The valve lifter 2 is constituted by a cylindrical main body portion 21 and a head wall portion 22. The head wall portion 22 serves to enclose an opening of an upper surface of the cylindrical main body portion 21. The cam 6 is contacted on the head wall portion 22. The cylindrical main body portion 21 is slidably attached onto a guide hole 11 of the cylinder head 1. The guide hole 11 is formed in an oblique direction to the cylinder head 1, i.e., with respect to a direction of gravity. Hence, the valve lifter 2 itself is revolved due to a friction developed between the cam 6 which is revolved and the upper surface of the head wall portion 22.

The valve stem 3 is slidably attached onto the guide hole 11. An axial center line of the valve stem 3 is coaxial to that of the valve lifter 2. A boss portion 22*a* is formed at a center portion of a lower surface of the head wall portion 22 of the valve lifter 2. A lower end of the boss portion 22*a* is contacted against an upper end surface of the valve stem 3. A circular groove 31 is formed adjacent to the upper end of the valve stem 3. The spring retainer 5 is attached onto the circular groove 31 via a valve collet 32. The valve spring 4 is compressed and attached between the spring retainer 5 and cylinder head 1. A biasing force of valve spring 4 serves to bias intake valve 8 or exhaust valve 9 in a valve closure direction.

In the valve lifter 2, an arc shaped junction R is formed between an inner surface of the valve lifter 2 and cylindrical main body portion 21, as shown in FIGS. 2 and 3.

At least one lubricating oil supply bore 23 is formed to penetrate through a plan portion of head wall portion 22 and a lower end exit thereof abuts the arc-shaped portion R. A lubricating oil dropped from a cam portion (cam journal portion) onto the upper surface of the head wall portion 22 is introduced into the lower surface of the head wall portion 22 via each lubricating oil supply bore 23.

Two lubricating oil supply bores 23 are installed at circumferential positions of head wall portion 23 symmetrical to each other with the axial center of the head wall portion 22.

Figure 4A:
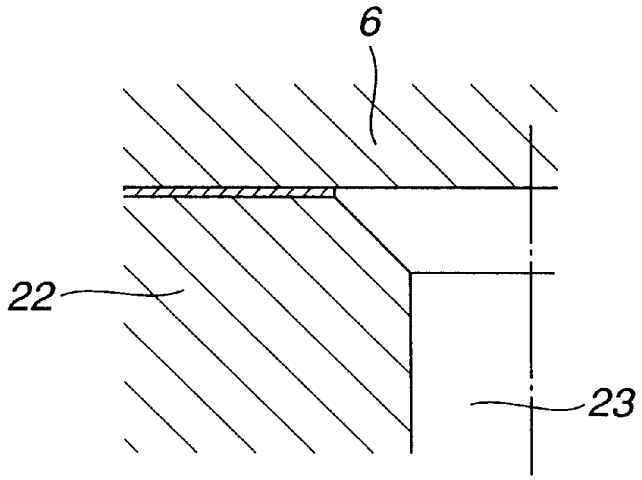
FIGS. 4A and 4B are expanded cross sectional views representing details of lubricating oil supply bores in the valve lifter in another comparative example and in the first embodiment shown in FIG. 1.
Figure 4B:
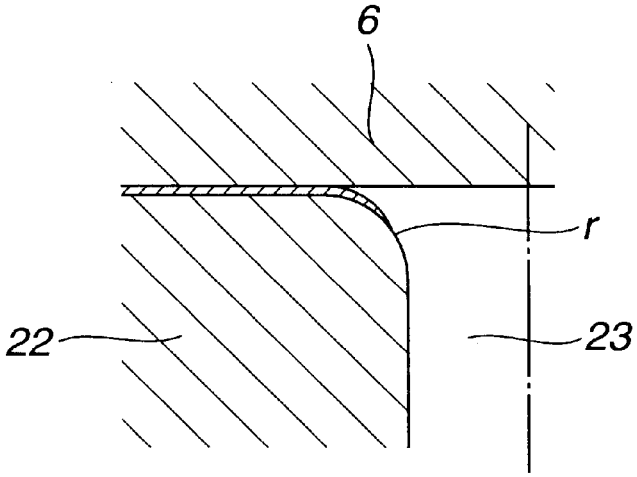

FIG. 4B shows an expanded cross sectional view of one lubricating oil supply bore 23.

As shown in FIG. 4B, an upper end opening edge portion which is an inlet of the lubricating oil at each lubricating oil supply bore 23 is chamfered to form an arc r.

Next, operation and advantage of the engine valve in the first embodiment will be described below.

Since valve lifter 2 in the first embodiment is structured as described above, the cam surface 6 causes the valve lifter 2 to be pressed in a downward direction against the biasing force of valve spring 4 when the cam 6 is revolved due to an operation of the internal combustion engine so that the intake valve 8 or exhaust valve 9 is opened or closed via valve lifter 2 and valve stem 3 against the biasing force of valve spring 4.

At this time, a load is transmitted via a contact portion between a lower end surface of the boss portion 22*a* of valve lifter 2 and an upper end surface of valve stem 3. The lubricating oil L dropped from the cam portion is supplied to this contact portion. That is to say, the lubricating oil L dropped on an upper surface of the head wall portion 22 of valve lifter 2 is introduced into the inside of the valve lifter 2 via each lubricating oil 23 and a part of it is transmitted over the inner surface of head wall portion 22 into the contact portion between the lower end surface of boss portion 22*a* and upper end surface of valve stem 3. The remaining part of the lubricating oil is dropped onto the upper surface of spring retainer 5. The lubricating oil L in a spray form jumped from the spring retainer 5 is supplied to the contact portion.

In addition, the valve lifter 2 itself revolves due to a friction developed between the cam surface and the upper surface of the head wall portion 22 along with the revolution of cam 6. This causes the lubricating oil supply bore 23 to be revolved.

At this time, even if the valve lifter 2 itself is disposed obliquely, a major part of the lubricating oil L is always dropped on the spring retainer 5. Thus, a sufficient lubrication of the contact portion between the lower end surface of the boss portion 22*a* and upper end surface of the valve stem 3 and the portion of the spring retainer 5 can be achieved.

In addition, since the valve lifter 2 is formed so that the lubricating oil supply bore 23 abuts on the arc-shaped portion R, the inlet of the lubricating oil supply bore 23 can be located at an outer peripheral edge portion as outer as possible in a range such that the lubricating oil L is prevented from dropping over the inner surface of valve lifter 2. Consequently, a pressure rise when the cam 6 is contacted against the inlet of each lubricating oil supply bore 23 can extremely be reduced.

Figure 5:
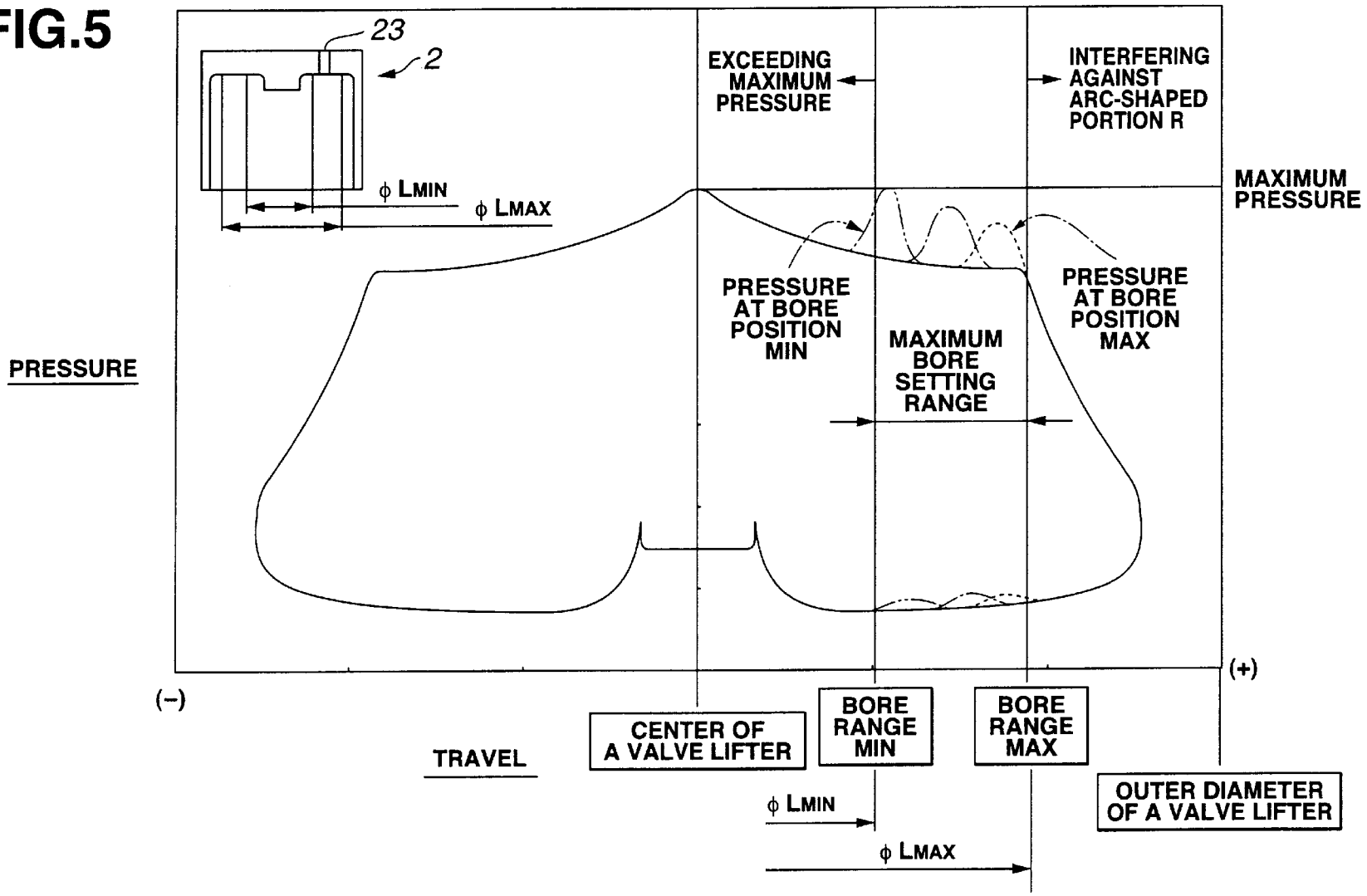
FIG. 5 is a characteristic graph representing a relationship between travel and pressure in the valve lifter of the engine valve assembly shown in FIG. 1.

That is to say, FIG. 5 shows a characteristic graph representing the relationship between a travel of a representative lubricating oil supply bore 23 and a pressure thereat. As shown by a dot-and-dot dashline, a dot-and-dash line, and a dot line in FIG. 5, as a position of lubricating oil supply bore 23 becomes nearer to the outer peripheral edge side of head wall portion 22, the pressure rise when the cam 6 becomes in touch with the inlet of each lubricating oil can be reduced. Hence, the pressure rise when the cam 6 is brought in close contact with the head wall portion 22 can be suppressed.

As shown in FIG. 4B, since the upper end opening edge portion which serves as the inlet of lubricating oil at each lubricating oil supply bore 23 is chamfered to form the arc r, the pressure rise when the cam 6 is contacted on the inlet of each lubricating oil supply bore 23 can be reduced as low as possible.

Since the edge is formed on the opening in the chamfering process as shown in FIG. 4A, an edge is formed on the opening. The pressure of the edge portion abruptly rises so that an oil film break occurs. Furthermore, since the chamfered upper end opening edge portion has the arc shape r as shown in FIG. 4B against the further rise in the pressure, such an abrupt rise in the pressure is suppressed so that the oil film break can be prevented.

Next, other preferred embodiments of the engine valve will be described.

It is noted that the same reference numerals as those described in the first embodiment designate like elements described in the first embodiment, explanations of these elements will be omitted herein, and only the difference points will be described below.

(Second Embodiment)

The valve lifter 2 in the engine valve of an internal combustion engine in a second preferred embodiment according to the present invention is different from that in the first preferred embodiment in a formed position of the lubricating oil supply bore 23.

Figure 6:
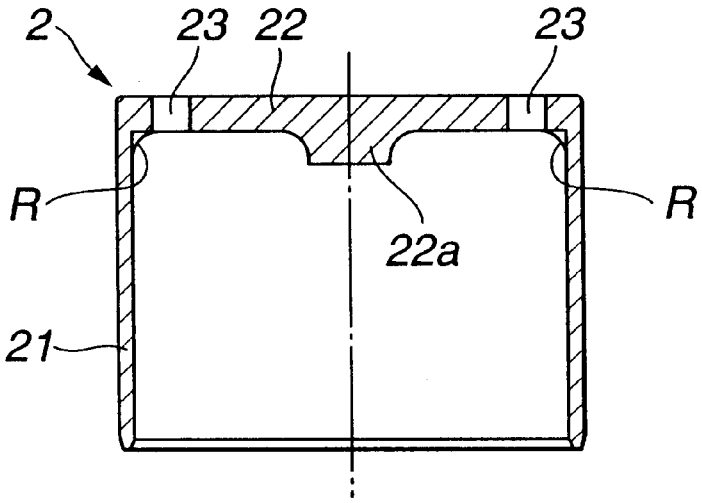
FIG. 6 is a longitudinal cross sectional view of the valve lifter in a second preferred embodiment of the engine valve assembly according to the present invention.
Figure 7:
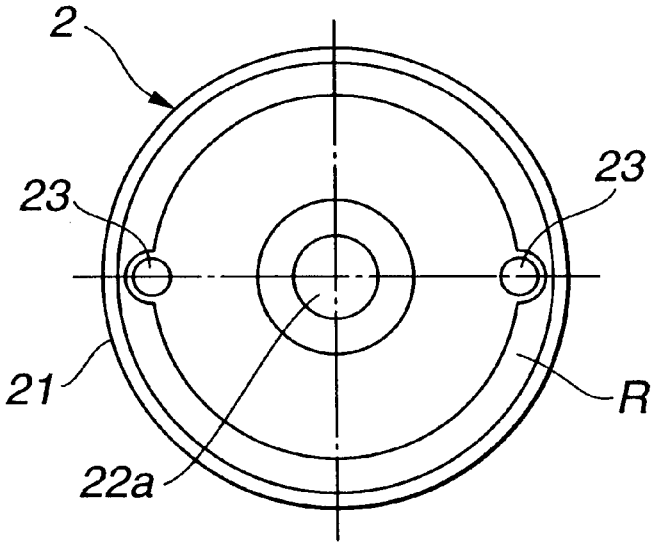
FIG. 7 is a bottom view of the valve lifter shown in FIG. 6.
Figure 2:
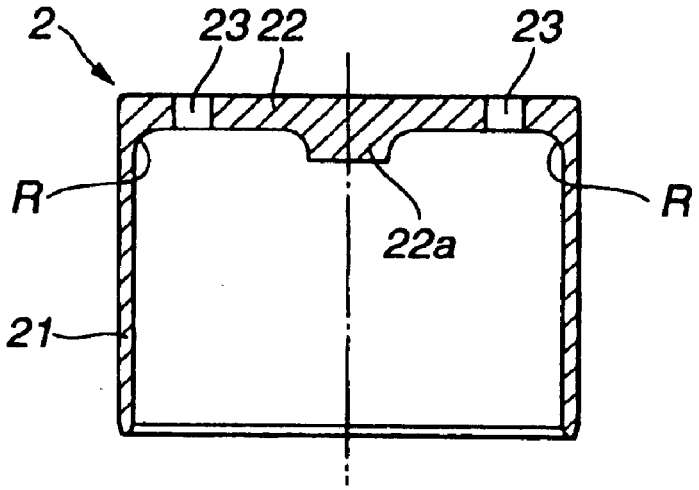

That is to say, as shown in FIGS. 6 and 7, opening edges of both lubricating oil supply bores 23 are formed on the head wall portion 22 to adjoin the arc-shaped portion R over a range of a plane surface of the head wall portion 22 so as not to abut a thickness portion of the cylindrical main body portion 21 and an outer peripheral edge portion of the head wall portion 21 of the valve lifter 2. Only those parts of the head wall portion in which the lubricating oil supply bores 23 are formed, are without the arc-shaped portion R (refer to FIG. 7).

As described above, since, in the second embodiment, the inlet of each lubricating oil supply bore 23 can be located on an outmost peripheral edge portion of the head wall portion 21 as maximum as possible in the range such that the lubricating oil L can be prevented from being dropped over the inner surface of the valve lifter 2, a pressure rise of the head wall portion 21 due to the pressing force by the cam 6 on the inlet of the lubricating oil supply bores 23 can further be reduced.

Although the invention has been described above by reference to certain embodiment of the invention, the invention is not limited to the embodiments described above. Modifications and variations of the embodiments described above will occur to those skilled in the art in the light of the above teachings.

For example, in the first and second preferred embodiments, the lubricating oil supply bores 23 are disposed on two portions in the circumferential direction mutually symmetrical to each other with the axial center portion of the head wall portion 22 as a center. However, the lubricating oil supply bore 23 may be formed in a single form, i.e., at a certain circumferential position since the cam 6 itself rotates.

In addition, although the lubricating oil supply bore 23 may be placed in a single form, i.e., at a certain circumferential position since the cam 6 itself rotates.

In addition, although the lubricating oil supply bore 23 is disposed in plural on the mutually symmetrical positions, the lubricating oil supply bore 23 may be disposed in plural at any circumferential positions or may be disposed in plural of three or more at a predetermined interval of distance in the circumferential direction of the head wall portion 22.

Although the valve lifter 2 is constituted integrally by a single member, a shim as described in a U.S. Pat. No. 5,749,341 may be disposed on the upper surface of the head wall portion 22.

In addition, although, in the first and second embodiments, each lubricating oil supply bore 23 is penetrated through the plane portion of the head wall portion 22, a through hole(s) may be formed in the shim and head wall portion 22 and circular grooves may be formed on the upper surface of the head wall portion 22 to constitute the lubricating oil supply bore(s).

Furthermore, the valve lifter 2 in each of the first and second preferred embodiments according to the present invention is carburized and Molybdenum coating (coated with Molybdenum), phosphate coating (coated with a phosphate salt), or is ground upon a treatment of a gas softened nitriding.

Since the valve lifter 2 is made under a carbonized process, the whole surface of the valve lifter 2 becomes hard so that an anti-wear characteristic becomes improved but the contents (net contents) of the valve lifter 2 can be maintained as soft as possible. Since the valve lifter 2 is coated with Molybdenum, a reduction in the friction can be achieved.

As the advantage of the gas softened nitriding and thereafter the grinding, both effects of friction reduction and anti-wear characteristic can be exhibited.

Finally, since the valve lifter 2, in each of the first and second preferred embodiments, is made of structural steels with specified hardenability bands of SCM420H, both reduction effects of friction and anti-wear characteristics can be achieved. It is noted that SCM420H is described in a Japanese Industrial Standards JIS G 4052 published in 1979 by a Japanese Industrial Standard Committee. Chemical components of SCM420H (old symbol is SCM22H) are 0.17 through 0.23 of C (%), 0.15 through 0.35 (%) of Si, 0.55 through 0.90 (%) of Mn, 0.030 or below of P, 0.85 through 1.25 (%) of Cr, and 0.15 through 0.35 (%) of Mo.

(Advantages of the Present Invention)

As described hereinabove, in the engine valve for the internal combustion engine described in the appended claim 1, the valve lifter comprises the cylindrical main body portion and the head wall portion by which the opening of the cylindrical main body portion is enclosed and with which the cam is brought in contact, the valve stem is contacted on the axial center of the valve lifter and disposed obliquely with respect to the direction of gravity, the lubricating oil supply bore is installed whose exit is opened to the inner space of the head wall portion, the lubricating oil supply bore is rotated due to the rotation of the valve lifter caused by the friction developed on the basis of the revolution of the cam, and the spring retainer is provided to support the end of the valve spring, the spring retainer being attached onto the valve stem, the engine valve, i.e., the valve lifter itself is rotated and this revolution of the valve lifter causes the exit of the lubricating oil bore to be revolved. Hence, even if the engine valve assembly (including the valve lifter) is inclined with respect to the direction of gravity, a major quantity of lubricating oil supplied to the engine valve is always dropped onto the spring retainer so that the contact portion between the valve stem and valve lifter and spring retainer portion can sufficiently be lubricated.

Since, in the engine valve as described in the appended claim 2, in the valve lifter is integrally formed of a single member and the lubricating oil supply bore is formed to penetrate through the head wall portion, an assured rotation of the valve lifter can be achieved. In addition, since the shim disclosed in the U.S. Pat. No. 5,749,341 described in the BACKGROUND OF THE INVENTION is not provided on the valve lifter, the number of assembled parts and a labor hour to fix the shim onto the valve lifter can be reduced.

Since, in the engine valve as described in the appended claim 3, the arc shaped portion is formed against the inner space of the valve lifter on the junction between the cylindrical main body and the head portion and the exit of the lubricating oil supply bore is formed on the plane portion of the head wall portion so that the exit of the lubricating oil supply bore is at least not opened onto the arch shaped portion, the engine valve as defined in the claim 8 can prevent furthermore the lubricating oil from moving onto the inner space of the valve lifter and dropping thereon.

Since, in the engine valve as described in the appended claim 4, the exit of the lubricating oil supply bore is penetrated through the plane portion of the head wall portion and is formed to be in touch with the arc shaped portion, the inlet of the lubricating oil supply bore can be positioned at the outer peripheral edge portion as maximum as possible over a range such that the lubricating oil can be prevented from being moved onto the inner space of the valve lifter and being dropped thereonto. Consequently, the pressure rise when the cam is brought in contact with the inlet of the lubricating oil supply bore can be reduced as small as possible.

Since, in the engine valve as described in the appended claim 5, the exit of the lubricating oil supply bore is formed in plural for each predetermined interval of distance in a circumferential direction of the head wall portion, the exit(s) of the other lubricating oil supply bore(s) is (are) placed at position(s) other than a lowest end portion in the gravity direction even if the exit of one of the lubricating oil supply bores are temporarily placed at the lowest end portion in the gravity direction. Hence, the lubricating oil can always be dropped onto the spring retainer at every rotation of the valve lifter.

Since, in the engine valve as described in the appended claim 6, the valve lifter comprises the cylindrical main body portion and a head wall portion by which the opening of the cylindrical main body portion is enclosed and with which the cam is brought in contact, the valve stem is contacted on an axial center of the valve lifter and is disposed obliquely with respect to the direction of gravity, the lubricating oil supply bore whose exit is opened to the inner space of the head wall portion and is formed in plural for each predetermined interval of distance in the circumferential direction of the head wall portion, and the spring retainer is provided to support the end of the valve spring, the spring retainer being attached onto the valve stem, the lubricating oil can always be dropped onto the spring retainer even if the valve lifter is rotated and dropped at any position since when the friction between the head wall portion of the valve lifter and the cam is so small that the valve lifter is not rotated and the exit of one of the lubricating oil supply bores is left positioned at the lowest end portion in the gravity direction, the exit(s) of the other lubricating oil supply bore(s) is (are) placed at the other position(s).

Since, in the engine valve as described in the appended claim 7, the exit of the lubricating oil supply bore is formed in plural at each position in a circumferential direction of the head wall position symmetrical to another of the other exit thereof, when the exit of one of the lubricating oil supply bores is positioned at the lowest end portion in the gravity direction, the exit of the other lubricating oil supply bore is always positioned at the uppermost end portion. Consequently, the assured lubrication of the contact portion between the valve stem and valve lifter and the spring retainer can be achieved.

Since, in the engine valve as described in the appended claim 8, the inlet of the lubricating oil supply bore is formed on the upper surface of the head wall portion on which the can is contacted and an opening edge of the inlet of the lubricating oil supply bore is formed in an arc shape, an abrupt rise in the pressure when the cam is brought in contact with the inlet of the lubricating oil supply bore can be suppressed.

It is noted that the advantages of the engine valve described in the other appended claims 9 through 16 are individually described in the above description.

The entire contents of a Japanese Patent Application No. 2000-159487 (filed in Japan on May 30, 2000) are herein incorporated by reference. Although the invention has been described above by reference to certain embodiment of the invention, the invention is not limited to the embodiments described above. Modifications and variations of the embodiments described above will occur to those skilled in the art in the light of the above teachings. The scope of the invention is defined with reference to the following claims.

What is claimed is:

1. An engine valve for an internal combustion engine, comprising: a valve lifter comprising a cylindrical main body portion and a head wall portion by which an opening of the cylindrical main body portion is enclosed and with which a cam is brought in contact;

a valve stem contacted on an axial center of the valve lifter and disposed obliquely with respect to a direction of gravity;

a lubricating oil supply bore whose exit is opened to an inner space of the head wall portion and is revolved due to a revolution of the valve lifter caused by a friction developed on the basis of a revolution of the cam; and a spring retainer to support an end of a valve spring, the spring retainer being attached onto the valve stem.

2. An engine valve for an internal combustion engine as claimed in claim 1, wherein the valve lifter is integrally formed of a single member and the lubricating oil supply bore is formed to penetrate through the head wall portion.

3. An engine valve for an internal combustion engine as claimed in claim 1, wherein an arc shaped portion is formed against the inner space of the valve lifter on a junction between the cylindrical main body and the head portion and the exit of the lubricating oil supply bore is formed on a plane portion of the head wall portion.

4. An engine valve for an internal combustion engine as claimed in claim 3, wherein the exit of the lubricating oil supply bore is penetrated through the plane portion of the head wall portion and is formed to be in touch with the arc shaped portion.

5. An engine valve for an internal combustion engine as claimed in claim 1, wherein the exit of the lubricating oil supply bore is formed in plural for each predetermined interval of distance in a circumferential direction of the head wall portion.

6. An engine valve for an internal combustion engine, comprising:

a valve lifter comprising a cylindrical main body portion and a head wall portion by which an opening of the cylindrical main body portion is enclosed and with which a cam is brought in contact;

a valve stem contacted on an axial center of the valve lifter and disposed obliquely with respect to a direction of gravity;

a lubricating oil supply bore whose exit is opened to an inner space of the head wall portion and is formed in plural for each predetermined interval of distance in a circumferential direction of the head wall portion; and a spring retainer to support an end of a valve spring, the spring retainer being attached onto the valve stem.

7. An engine valve for an internal combustion engine as claimed in claim 6, wherein the exit of the lubricating oil supply bore is formed in plural at each position in a circumferential direction of the head wall position symmetrical to another of the other exit thereof.

8. An engine valve for an internal combustion engine as claimed in claim 6, wherein an inlet of the lubricating oil supply bore is formed on an upper surface of the head wall portion on which the cam is contacted and an opening edge of the inlet of the lubricating oil supply bore is formed in an arc shape.

9. An engine valve for an internal combustion engine as claimed in claim 1, wherein the valve spring comprises a coil spring.

10. An engine valve for an internal combustion engine as claimed in claim 1, wherein the valve lifter is carbonized.

11. An engine valve for an internal combustion engine as claimed in claim 10, wherein the valve lifter is coated with a Molybdenum.

12. An engine valve for an internal combustion engine as claimed in claim 10, wherein the valve lifter is treated with a phosphating.

13. An engine valve for an internal combustion engine as claimed in claim 10, wherein the valve lifter is treated with a gas softened nitriding and, thereafter, is ground.

14. An engine valve for an internal combustion engine as claimed in claim 1, wherein the valve lifter is made of SCM420H.

15. An engine valve for an internal combustion engine, comprising: a valve lifter comprising a cylindrical main body portion and a head wall portion integrally formed with the cylindrical main body and by which an opening of the cylindrical main body portion is enclosed and with which a cam is brought in contact;

a valve stem contacted on an axial center of the valve lifter and disposed obliquely with respect to a direction of gravity;

a lubricating oil supply bore formed to penetrate through the head wall portion and whose exit is opened to an inner space of the head wall portion and is revolved due to a revolution of the valve lifter caused by a friction developed on the basis of a revolution of the cam; and a spring retainer to support an end of a valve spring, the spring retainer being attached onto the valve stem.

16. An engine valve for an internal combustion engine, comprising: a valve lifter comprising a cylindrical main body portion and a head wall portion by which an opening of the cylindrical main body portion is enclosed and with which a cam is brought in contact;

a valve stem contacted on an axial center of the valve lifter and disposed obliquely with respect to a direction of gravity;

a lubricating oil supply bore whose exit is opened to an inner space of the head wall portion and is revolved due to a revolution of the valve lifter caused by a friction developed on the basis of a revolution of the cam and whose inlet is formed on an upper surface of the head wall portion on which the cam is contacted, an opening edge of the inlet of which is formed in an arc shape; and a spring retainer to support an end of a valve spring, the spring retainer being attached onto the valve stem.

* * * * *

US006397806C1

(12) EX PARTE REEXAMINATION CERTIFICATE (5912th)

United States Patent

Imai et al.

(10) Number: US 6,397,806 C1

(45) Certificate Issued: Oct. 2, 2007

(54) ENGINE VALVE ASSEMBLY FOR INTERNAL COMBUSTION ENGINE

(75) Inventors: Hiroaki Imai, Saitama (JP); Hirokazau Uehara, Kanagawa (JP); Seiji Tsuruta, Kanagawa (JP)

(73) Assignee: Hitachi, Ltd., Chiyoda-Ku, Tokyo-To (JP)

Reexamination Request:
No. 90/007,708, Sep. 2, 2005

Reexamination Certificate for:

| | |
|---|---|
| Patent No.: | **6,397,806** |
| Issued: | **Jun. 4, 2002** |
| Appl. No.: | **09/864,303** |
| Filed: | **May 25, 2001** |

(30) Foreign Application Priority Data

May 30, 2000 (JP) ..... 2000-159487

(51) Int. Cl.
*F01L 1/24* (2006.01)

(52) U.S. Cl. ..... 123/90.48; 123/90.33; 123/90.49; 123/196 M; 184/6.9

(58) Field of Classification Search ..... None
See application file for complete search history.

(56) References Cited

U.S. PATENT DOCUMENTS 5,749,341 A 5/1998 Hosaka et al.

FOREIGN PATENT DOCUMENTS

| | | |
|---|---|---|
| JP | 57-200609 U | 12/1982 |
| JP | S59-160016 A | 9/1984 |
| JP | S62-20118 U | 2/1987 |
| JP | 64-13202 U | 1/1989 |
| JP | 4-113706 U | 10/1992 |
| JP | 8-74527 A | 3/1996 |

OTHER PUBLICATIONS

Handbook of Automotive Technology, Jun. 15, 1972, p. 72.

*Primary Examiner*—Bibhu Mohanty

(57) ABSTRACT

In an engine valve assembly, a valve lifter comprises a cylindrical main body portion and a head wall portion by which an opening of the cylindrical main body portion is enclosed and with which a cam is brought in contact, a valve stem is contacted on an axial center of the valve lifter and is disposed obliquely with respect to a direction of gravity, an exit of a lubricating oil supply bore is opened to an inner space of the head wall portion and is revolved due to a revolution of the valve lifter caused by a friction developed on the basis of a revolution of the cam, and a spring retainer supports an end of a valve spring, the spring retainer being attached onto the valve stem.

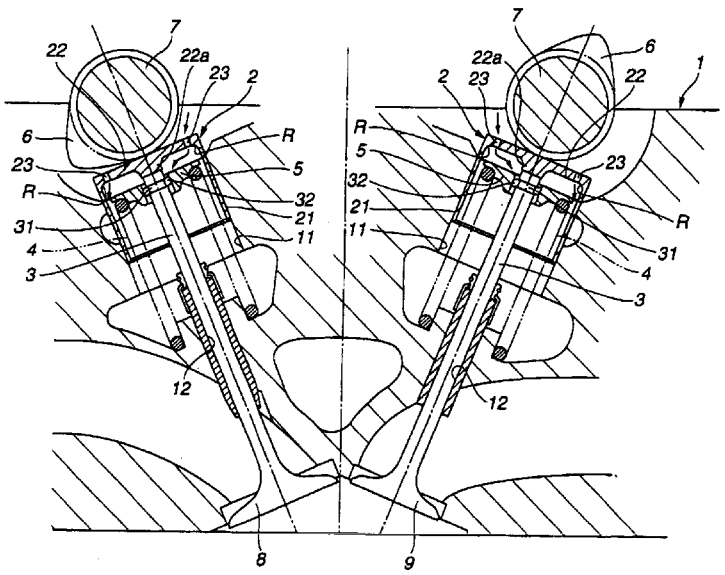

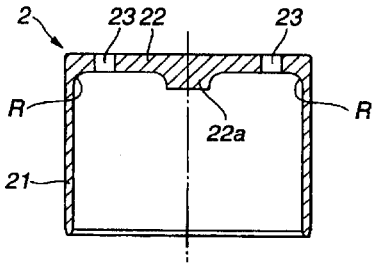

AMENDED

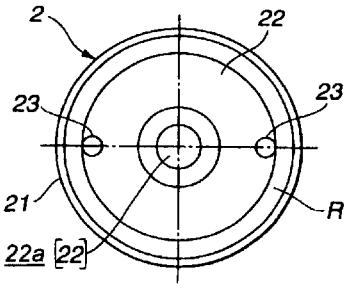

FIG.3
AMENDED
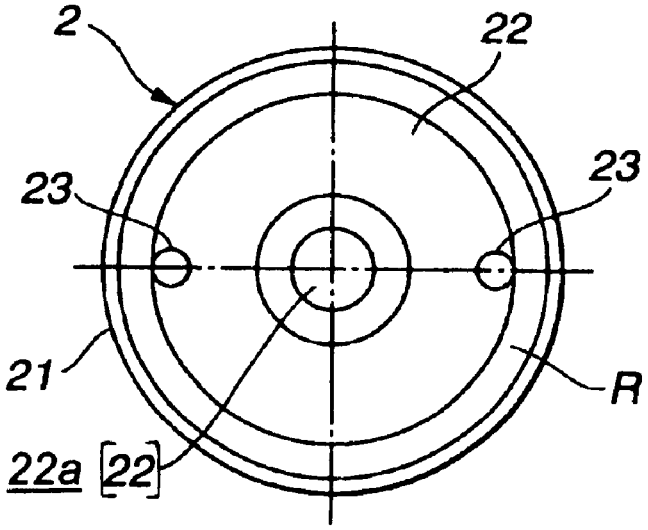

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, line 65 to column 4, line 4:

At least one lubricating oil supply bore 23 is formed to penetrate through a [plan] *plane* portion of head wall portion 22 and a lower end exit thereof abuts the arc-shaped portion R. A lubricating oil dropped from a cam portion (cam journal portion) onto the upper surface of the head wall portion 22 is introduced into the lower surface of the head wall portion 22 via each lubricating oil supply bore 23.

Column 4, lines 25–39:

At this time, a load is transmitted via a contact portion between a lower end surface of the boss portion 22a of valve lifter 2 and an upper end surface of valve stem 3. The lubricating oil L dropped from the cam portion is supplied to this contact portion. That is to say, the lubricating oil L dropped on an upper surface of the head wall portion 22 of valve lifter 2 is introduced into the inside of the valve lifter 2 via each lubricating oil *supply bore* 23 and a part of it is transmitted over the inner surface of head wall portion 22 into the contact portion between the lower end surface of boss portion 22a and upper end surface of valve stem 3. The remaining part of the lubricating oil is dropped onto the upper surface of spring retainer 5. The lubricating oil L in a spray form jumped from the spring retainer 5 is supplied to the contact portion.

THE DRAWING FIGURES HAVE BEEN CHANGED AS FOLLOWS:

Ref. numeral "22" has been changed to "22a".

AS A RESULT OF REEXAMINATION, IT HAS BEEN DETERMINED THAT:

Claims 1, 6, 15 and 16 are determined to be patentable as amended.

Claims 2–5 and 7–14, dependent on an amended claim, are determined to be patentable.

New claims 17–19 are added and determined to be patentable.

1. An engine valve for an internal combustion engine, comprising:

a valve lifter comprising a cylindrical main body portion and a head wall portion *integrally formed with the cylindrical main body portion and* by which an opening of the cylindrical main body portion is enclosed and with which a cam is brought in *direct* contact, *the head wall portion having an axially central boss integrally formed therewith and projecting inside the cylindrical main body portion*;

a valve stem contacted on [an axial center] *the axially central boss* of the valve lifter and disposed obliquely with respect to a direction of gravity;

a lubricating oil supply bore whose exit is opened to an inner space of the head wall portion *at a location spaced from the boss and spaced from the cylindrical main body portion* and is revolved due to a revolution of the valve lifter caused by a friction developed on the basis of a revolution of the cam *in direct contact with the head wall portion*; and a spring retainer to support an end of a valve spring, the spring retainer being attached onto the valve stem.

6. An engine valve for an internal combustion engine, comprising:

a valve lifter comprising a cylindrical main body portion and a head wall portion *integrally formed with the cylindrical main body portion and* by which an opening of the cylindrical main body portion is enclosed and with which a cam is brought in *direct* contact, *the head wall portion having an axially central boss integrally formed therewith and projecting inside the cylindrical main body portion*;

a valve stem contacted on [an axial center] *the axially central boss* of the valve lifter and disposed obliquely with respect to a direction of gravity;

a lubricating oil supply bore whose exit is opened to an inner space of the head wall portion *at a location spaced from the boss and spaced from the cylindrical main body portion* and is formed in plural for each predetermined interval of distance in a circumferential direction of the head wall portion; and a spring retainer to support an end of a valve spring, the spring retainer being attached onto the valve stem.

15. An engine valve for an internal combustion engine, comprising:

a valve lifter comprising a cylindrical main body portion and a head wall portion integrally formed with the cylindrical body *portion* and by which an opening of the cylindrical main body portion is enclosed and with which a cam is brought in *direct* contact, *the head wall portion having an axially central boss integrally formed therewith and projecting inside the cylindrical main body portion*;

a valve stem contacted on [an axial center] *the axially central boss* of the valve lifter and disposed obliquely with respect to a direction of gravity;

a lubricating oil supply bore formed to penetrate through the head wall portion and whose exit is opened to an inner space of the head wall portion *at a location spaced from the boss and spaced from the cylindrical main body portion* and is revolved due to a revolution of the valve lifter caused by a friction developed on the basis of a revolution of the cam *in direct contact with the head wall portion*; and a spring retainer to support an end of a valve spring, the spring retainer being attached onto the valve stem.

16. An engine valve for an internal combustion engine, comprising:

a valve lifter comprising a cylindrical main body portion and a head wall portion *integrally formed with the cylindrical main body portion and* by which an opening of the cylindrical main body portion is enclosed and with which a cam is brought in *direct* contact, *the head wall portion having an axially central boss integrally formed therewith and projecting inside the cylindrical main body portion*;

a valve stem contacted on [an axial center] *the axially central boss* of the valve lifter and disposed obliquely with respect to a direction of gravity;

a lubricating oil supply bore whose exit is opened to an inner space of the head wall portion *at a location spaced from the boss and spaced from the cylindrical main body portion* and is revolved due to a revolution of the valve lifter caused by a friction developed on the basis of a revolution of the cam and whose inlet is formed on an upper surface of the head wall portion on which the cam is *directly* contacted, an opening edge of the inlet of which is formed in an arc shape; and a spring retainer to support an end of a valve spring, the spring retainer being attached onto the valve stem.

*17. An engine valve for an internal combustion engine as claimed in claim 1, wherein the spring retainer is attached to the valve stem inside the cylindrical main body portion.*

*18. An engine for an internal combustion engine as claimed in claim 17, wherein the spring retainer underlies the lubricating oil supply bore in the axial direction.*

*19. An engine valve for an internal combustion engine as claimed in claim 1, wherein an inlet of the lubricating oil supply bore is formed on the surface of the head wall portion which the cam contacts and is located where the contact pressure of the cam on the inlet does not exceed the maximum contact pressure of the cam on the head wall portion at any location where there is no inlet.*

* * * * *